United States Patent [19]

Schneider

[11] 4,114,828

[45] Sep. 19, 1978

[54] BOBBIN

[75] Inventor: Bernhard Hank Schneider, Greenville, S.C.

[73] Assignee: Steel Heddle Manufacturing Company, Greenville, S.C.

[21] Appl. No.: 799,372

[22] Filed: May 23, 1977

[51] Int. Cl.[2] ..... B65H 75/10

[52] U.S. Cl. ..... 242/118.3

[58] Field of Search ..... 242/118.3, 118.31, 118.32, 242/118

[56] References Cited

U.S. PATENT DOCUMENTS

| | | | |
|---|---|---|---|
| 1,237,457 | 8/1917 | Benjamin | 242/118.31 |
| 1,291,372 | 1/1919 | Benjamin | 242/118.31 |
| 3,292,876 | 12/1966 | Limantour | 242/118.31 |

FOREIGN PATENT DOCUMENTS

| | | | |
|---|---|---|---|
| 706,326 | 3/1931 | France | 242/118.31 |

*Primary Examiner*—George F. Mautz

*Attorney, Agent, or Firm*—Bailey, Dority & Flint

[57] ABSTRACT

A bobbin for use in a shuttle having a shuttle spring provided with grooves therein for receiving the rings of the bobbin. The bobbin has a resilient sleeve provided on a reduced diameter portion of the butt end. The sleeve has grooves provided therein for receiving the rings. Vibrations between the shuttle and the bobbin are minimized by the resilient sleeve thus reducing the wear of the shuttle spring.

5 Claims, 2 Drawing Figures

BOBBIN

BACKGROUND OF THE INVENTION

The present invention relates to a bobbin and, more particularly, to a bobbin provided with a resilient sleeve interposed between the butt end of the bobbin and the rings carried thereon.

Heretofore, bobbins for use in shuttles in weaving cloth and the like have normally been constructed of wood and plastic. The bobbins usually have a tapered elongated barrel which terminates in a butt end integral therewith. Positioned on the butt end of the bobbin are grooves in which retaining rings are carried. When the bobbin is inserted within a shuttle, the retaining rings fit within grooves provided in a shuttle spring. As vibrations are imparted to the shuttle and bobbin, the grooves in the shuttle spring begin to wear. Another problem encountered with bobbins is that any deflection of the barrel from its normal operating position causes the jaws of the shuttle spring to flex inwardly and outwardly slightly. Over a long period of time, this flexing may cause the jaws of the shuttle spring to break as a result of fatigue.

Bobbins heretofore utilized have been constructed of both wood and plastic and examples of such bobbins are disclosed in U.S. Pat. Nos. 3,993,265 and 3,292,876. Normally, these bobbins are constructed in one unitary piece with the retaining rings positioned in grooves carried on the butt end of the bobbin.

However, bobbins have been constructed in two pieces with the butt being attached to the head by means of an annulus which has corrogations provided in the outer wall for forming spaced rings. Examples of bobbins utilizing an annulus are disclosed in U.S. Pat. Nos. 1,291,372 and 1,237,457. In these particular bobbins, the annulus has a flange which is bent downwardly over the inner end of the butt end for securing the annulus to the bobbin. A hot fluid is placed between the ferrule and the bobbin for securing such together. As a result of the hardened layer between the ferrule and the butt of the bobbin, such tends to cushion the blows imparted to the bobbin when the bobbin is being inserted in a shuttle.

SUMMARY OF THE INVENTION

The invention pertains to a bobbin for use in a shuttle having a shuttle spring provided with grooves therein for receiving the rings of the bobbin. The bobbin includes an elongated shank portion which terminates in an enlarged diameter cylindrical butt end integral therewith. The butt end has a reduced diameter intermediate cylindrical portion provided thereon. A resilient sleeve is carried on the reduced diameter portion of the butt end.

The sleeve has grooves molded therein for receiving a plurality of longitudinally spaced metal rings. Radially extending walls are provided adjacent the reduced diameter intermediate portion on the butt end for holding the sleeve in position on the butt end of the bobbin.

Accordingly, it is an important object of the present invention to provide a bobbin which has a sleeve interposed between the retaining rings and the butt of the bobbin for minimizing vibrations during weving as well as minimizing wear to the shuttle spring.

Another important object of the present invention is to provide a bobbin with a sleeve on the butt end thereof which aids in maintaining retaining rings carried on the butt end thereof dimensionally stable and uniformly round.

These and other objects and advantages of the invention will become apparent upon reference to the following specification, attendant claims and drawing.

DESCRIPTION OF A PREFERRED EMBODIMENT

Figure 1:
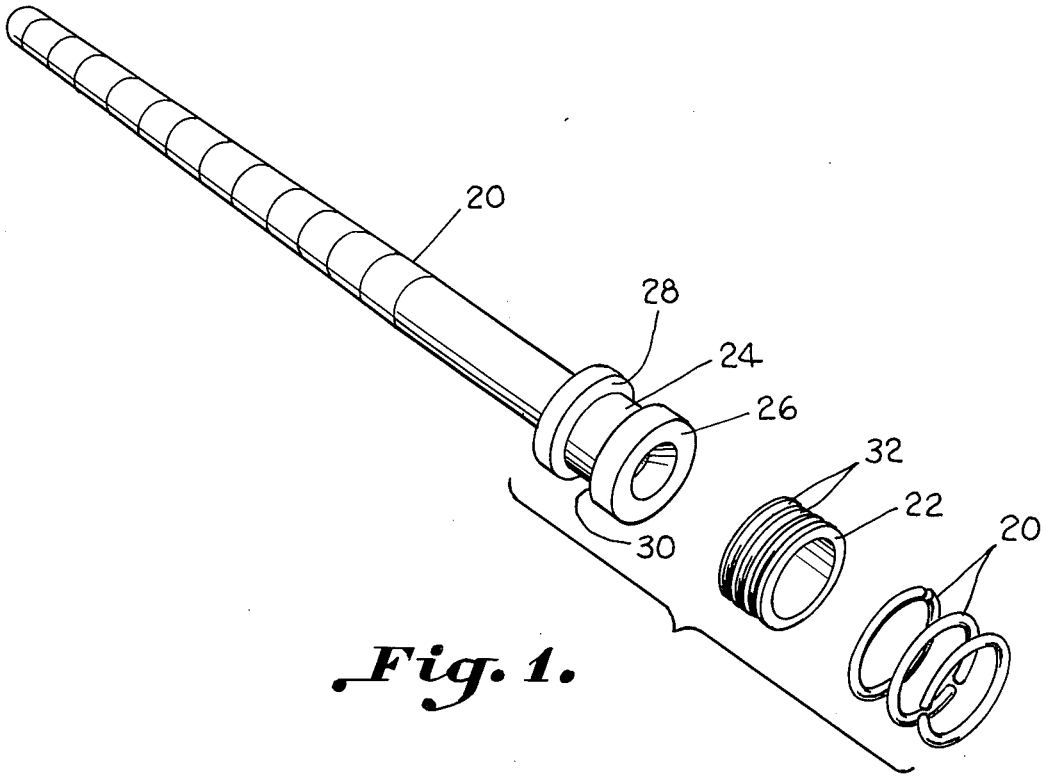
FIG. 1 is an exploded perspective view illustrating a bobbin constructed in accordance with the present invention positioned within a shuttle.
Figure 2:
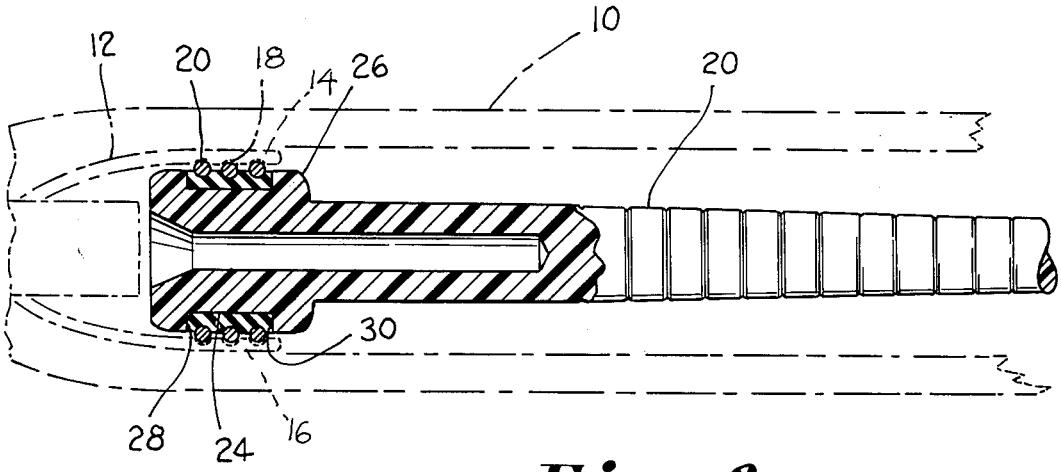
FIG. 2 is a sectional view illustrating a bobbin constructed in accordance with the present invention.

Referring in more detail to FIG. 2 of the drawing, there is illustrated a conventional shuttle 10 having a shuttle spring 12 provided therein. The shuttle spring has opposed jaws 14 and 16 provided for receiving the butt end of the bobbin. The jaws 14 and 16 have grooves 18 provided therein into which the retaining rings 20 are carried on the butt end of the bobbin. In normal operation, the retaining rings 20 are secured directly to the butt end of the bobbin and any vibrations imparted to the shuttle are transferred directly through the rings to the bobbin. These vibrations could adversely affect the take-off of yarn from the barrel 20 of the bobbin.

In order to dampen the vibrations between the shuttle and the bobbin, a resilient sleeve 22 is placed on a reduced diameter portion 24 of the butt end 26 of the bobbin. The sleeve 22, in one particular embodiment, is constructed of 95 D Durometer polyurethane. The sleeve is merely stretched so as to slip over the left hand end of the bobbin for being positioned within the reduced diameter portion 24. Radially extending walls 28 and 30 are carried on opposite sides of reduced diameter portion 24 for securing the sleeve 22 on the reduced diameter portion.

The sleeve 22 has circular grooves 32 molded therein for receiving the rings 20.

It has been found that when there are minor deviations of the barrel 20 from the normal longitudinal axis extending through the shuttle, instead of the rings 20 forcing the jaws 16 and 18 part, this slight twisting or deviation in the bobbin constructed in accordance with the invention is absorbed in the sleeve 22. Thus, the amount of flexing of the jaws 16 and 18 is reduced.

As a result of the resiliency of the sleeve 22, the rings 20 appear to retain a more uniform roundness than when the rings are secured directly to the head of the bobbin. Furthermore, the resiliency of the sleeve 22 tends to compensate for dimensional changes in the head of the bobbin due to heat and humidity.

Since the rings 20 are carried on the resilient sleeve if, when the bobbin is inserted in the shuttle, the grooves in the shuttle spring do not align properly with the metal rings, the metal rings will adjust to fit properly. In conventional bobbins manufactured of hard material such as wood, if the rings do not match up perfectly with the groove, such causes looseness between the bobbin and the spring causing the bobbin to wiggle and wobble often causing filling yarn to break. This can be caused by either an angle mismatch between the spring and the bobbin or a lateral mismatch. By mounting the rings on the resilient sleeve 22, the rings are permitted to shift slightly to produce a more accurate fit between the grooves of the shuttle spring and the rings.

As previously mentioned, the bobbin may be constructed of any suitable material such as plastic as disclosed in U.S. Pat. No. 3,993,265 or wood.

While a preferred embodiment of the invention has been described using specific terms, such description is for illustrative purposes only, and it is to be understood that changes and variations may be made without departing from the spirit or scope of the following claims.

What is claimed is:

1. A bobbin for use in a shuttle having a shuttle spring provided with grooves therein for receiving the rings of a bobbin for securing the bobbin therein, said bobbin comprising:

an elongated shank portion, an enlarged diameter cylindrical butt end integral with one end of said shank portion, a reduced diameter intermediate cylindrical portion provided on said butt end of said bobbin, a resilient sleeve carried on said reduced diameter portion of said butt end, and a plurality of longitudinally spaced metal rings carried on said resilient sleeve, said rings being separated and independent from each other, and means for retaining said rings on said sleeve so when said rings of said bobbin are inserted in said grooves of said shuttle spring movement between said rings and grooves of said shuttle spring are minimized by said resilient sleeve absorbing shocks and minor deflections of said shank portion.

2. The bobbin as set forth in claim 1 further comprising:

radially extending walls carried on said butt end on opposite sides of said reduced diameter intermediate cylindrical portion, and said resilient sleeve being prevented from shifting longitudinally by said radially extending walls.

3. The bobbin as set forth in claim 1 wherein said sleeve is a 95D Durometer polyurethane.

4. The bobbin as set forth in claim 1 wherein said means for retaining said rings on said sleeve include longitudinally spaced circular grooves molded in the surface of said sleeve.

5. The bobbin as set forth in claim 1 wherein said butt and shank portions are molded from plastic material into a hardened integral one-piece bobbin.

* * * * *